US005103762A

United States Patent [19]

Long et al.

[11] Patent Number: 5,103,762

[45] Date of Patent: Apr. 14, 1992

[54] SPRAY PAINT SHIELD

[75] Inventors: Chris D. Long, Sarasota, Fla.; Edward K. Guerry, Fairfield, Conn.

[73] Assignee: Classic Shields, Inc., Sarasota, Fla.

[21] Appl. No.: 557,673

[22] Filed: Jun. 24, 1990

[51] Int. Cl.[5] ..... B05C 11/00; B05C 21/00

[52] U.S. Cl. ..... 118/504; 428/120

[58] Field of Search ..... 428/119, 120; 118/504, 118/505

[56] References Cited

U.S. PATENT DOCUMENTS

| | | | |
|---|---|---|---|
| 3,565,038 | 2/1971 | Van Barriger | 118/504 |
| 4,085,703 | 4/1978 | Glowacki | 118/504 |
| 4,574,731 | 3/1986 | Stevens et al. | 118/504 |
| 4,962,722 | 10/1990 | Thompson | 118/504 |

*Primary Examiner*—Alexander S. Thomas
*Attorney, Agent, or Firm*—Charles J. Prescott

[57] ABSTRACT

A spray paint shield for manually protectively covering a portion of a wall or ceiling when the adjoining ceiling or wall portion, respectively, is being sprayed painted. The spray shield includes a generally flat, elongated sheet of thin, flexible material such as stainless steel or aluminum, having a straight distal or working edge and an elongated handle pivotally connected to, and extending from, the flat sheet at a mid point of the edge of the flat sheet opposite its distal edge. The handle is lockably positionable within the plane defined by the flat sheet at any convenient acute angle to the distal edge. A drip guard flange for collecting paint running on the working surface of the flat sheet and several embodiments of the locking mechanism are also provided.

5 Claims, 3 Drawing Sheets

SPRAY PAINT SHIELD

BACKGROUND OF THE INVENTION

This invention relates generally to paint accessories, and more particularly to a paint spray shield manually held against a flat surface or corner to keep paint from being sprayed thereupon.

A considerable amount of interior wall and ceiling painting is now accomplished by spray painting. This is particularly true in commercial settings where high volume justifies the additional spray painting equipment expense.

Typically, a ceiling is, however painted with a paint or texturing which is different from that of the walls. Additionally, some walls are also painted a different color from a wall adjacent thereto. Therefore, protecting the first-painted wall or ceiling surface as the second-painted ceiling or wall surface, respectively is spray painted is desired.

One such device which is similar to that of the present invention is now presently available. This device includes a generally flat, elongated thin flexible sheet having a rigidly connected elongated handle generally lying in the plane of the flat sheet disposed therefrom. This device includes a straight distal or working edge which allows the user to manually place the distal edge into a corner between the ceiling and wall so that a portion of one surface may be protected while spray painting against the adjoining surface. However, manipulation of this rigid-handle prior art device is cumbersome, detracting from the effective use thereof.

The present invention provides an easily angularly adjustable elongated handle connected to the flexible flat sheet so that the user may have a wider range of spraying from one position which may be atop a ladder. Improved, quicker alignment of the device into a corner is also facilitated.

BRIEF SUMMARY OF THE INVENTION

This invention is directed to a spray paint shield for manually protectively covering a portion of a wall or ceiling when the adjoining ceiling or wall portion, respectively, is being spray painted. The spray shield includes a generally flat, elongated sheet of thin, flexible material such as stainless steel or aluminum, having a straight distal or working edge and an elongated handle pivotally connected to, and extending from, the flat sheet at a mid point of the edge of the flat sheet opposite its distal edge. The handle is lockably positionable within the plane defined by the flat sheet at any convenient acute angle to the distal edge. A drip guard flange for collecting paint running on the working surface of the flat sheet and several embodiments of the locking mechanism are also provided.

It is therefore an object of this invention to provide an easily adjustable paint spray shield which will accommodate its use over a greater surface area to be painted from one location.

It is another object of this invention to provide a paint spray shield with an easily adjustable pivoted handle connected thereto to facilitate quicker, more accurate positioning of the distal or working edge of the device against a corner between adjoining interior flat surfaces, one of which is to be painted, the other which is to be protectively shielded by the device from spray paint.

In accordance with these and other objects which will become apparent hereinafter, the instant invention will now be described with reference to the accompanying drawings

DETAILED DESCRIPTION OF THE INVENTION

Figure 1:
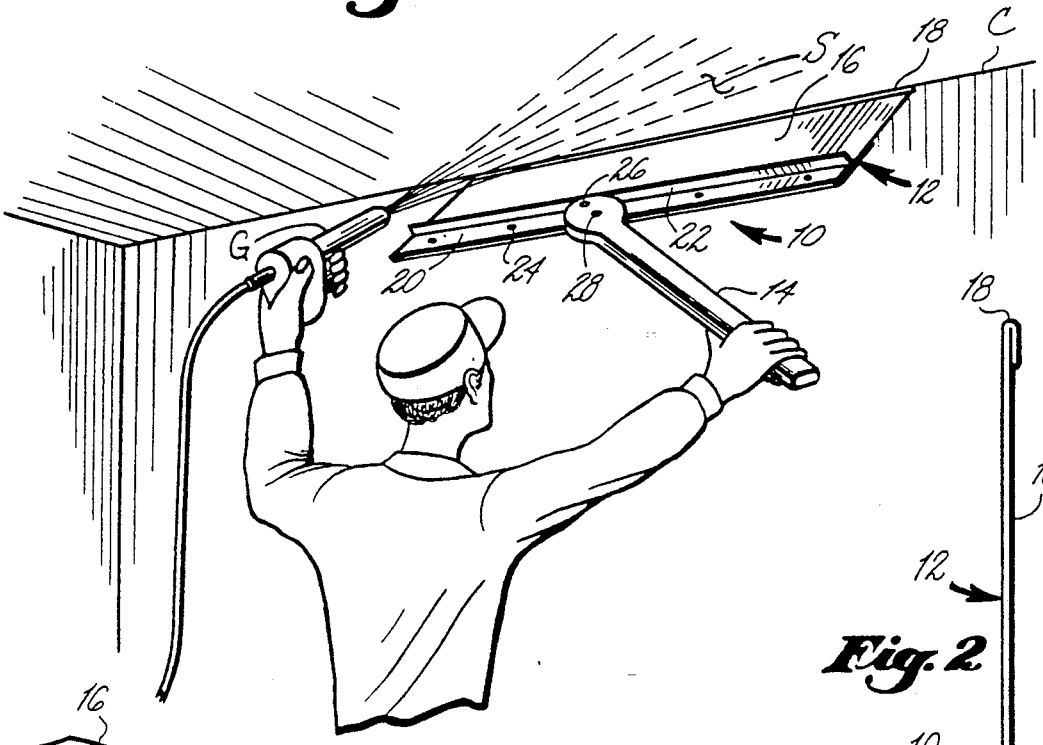
FIG. 1 is a perspective view of one embodiment of the invention in use.
Figure 2:
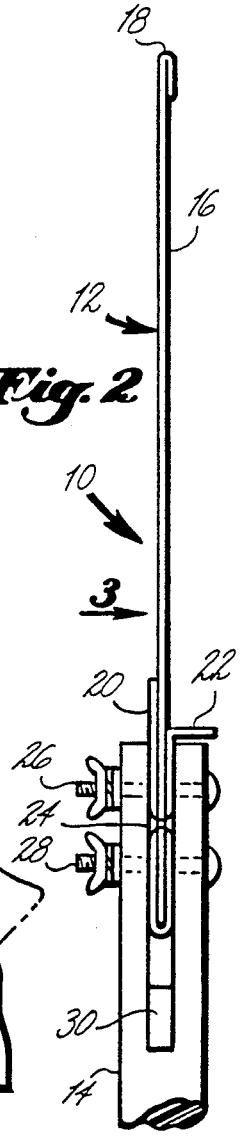
FIG. 2 is a left side elevation view of FIG. 1.

Referring now to the drawings, and particularly to FIGS. 1 to 4, one embodiment of the invention is shown generally at numeral 10. This embodiment 10 includes a shield assembly 12 having a generally flat, elongated flexible sheet 16 held within a U-shaped member 20 by rivets 24. This embodiment 10 also includes a slotted elongated handle 14 which is pivotally connected within the slot by threaded fastener 28 to one longitudinal edge of assembly 12 such that handle 14 pivots about fastener 28 in the plane defined by the flexible sheet 16.

The flexible sheet 16 includes a folded-over longitudinal distal edge 18 which forms the working edge of assembly 12. This distal edge 18 is intended to be placed tightly into a corner C of an interior room between a wall and ceiling surface as shown or between adjoining wall surfaces. By grasping the handle 14 at its distal end as shown, the user may apply spray paint from a paint spray gun G onto surface S of, for example, the ceiling, whereby overspray will be collected on the working or exposed surface of flexible sheet 16, rather than be inadvertently deposited against the already-painted wall surface.

Figure 3:
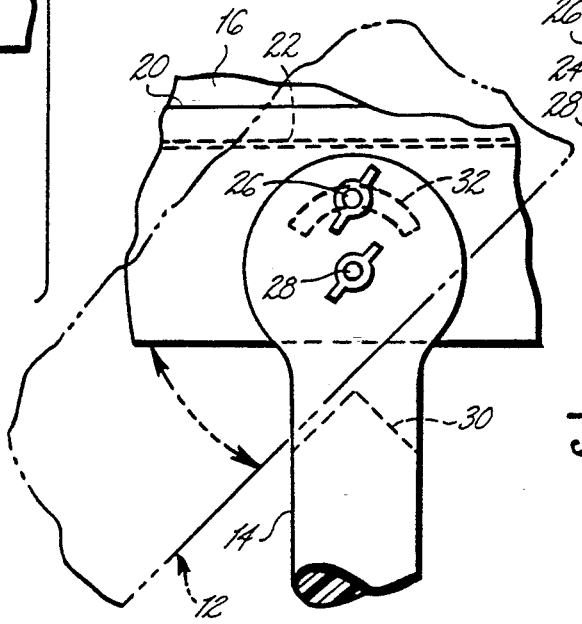
FIG. 3 is an enlarged rear elevation view of the invention shown in FIG. 1 in the direction of arrows 3—3 in FIG. 2.

To facilitate the application of spray paint as shown in FIG. 1 over a larger surface area S from one position as when a user is positioned on a ladder, handle 14 is pivotally adjustable back and forth in the direction of the arrow shown in phantom in FIG. 3. Thus, the user may select any desired acute angle orientation of handle 14 to distal edge 18 which will allow the user to stretch in both directions from directly in front of him to continue to apply spray paint onto surface S without moving from that position. Additionally, the flexible sheet, combined with the convenient angular adjustment also helps to insure that the distal edge 18 will be uniformly placed into the corner C so as to provide a sharp painted edge along the corner C.

Figure 4:
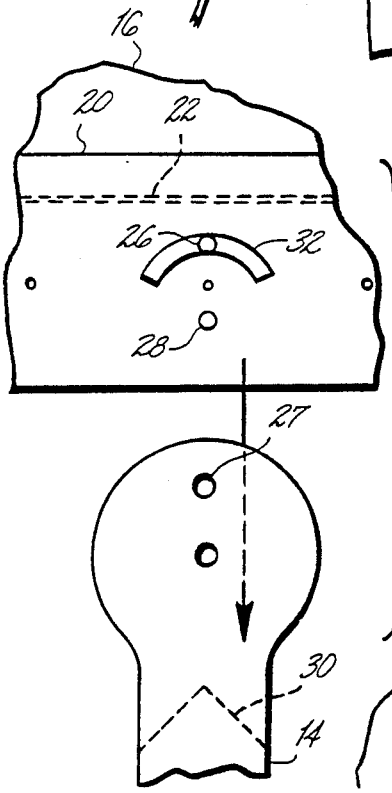
FIG. 4 is an exploded view of FIG. 3.

Once an angular relationship between handle 14 and distal edge 18 is selected, a separate threaded fastener 26, having a tightenable wing nut may be tightened to secure that position. This threaded fastener 26 fits through an aperture 27 transversely through handle 14 as best seen in FIG. 4 and also aligns and registers with an arcuate slot 32 formed through the assembly 12 radially around fastener 28. Handle 14 includes a recess 30 to accommodate the pivotal movement of the handle 14 with respect to assembly 12 as shown in phantom in FIG. 3.

The U-shaped reinforcement 20 is also provided with a laterally extending drip flange 22 so that excess spray paint collecting atop the exposed working surface of sheet 16 will not easily run or drip therefrom. This flange 22 also provides additionally rigidity and straightness to flexible sheet 16 so as to maintain the linear integrity of distal edge 18.

The preferred material for the manufacture of the flexible sheet 16 is either thin aluminum or stainless steel plate of sufficient thickness so as to maintain the overall integrity and shape of the assembly 12, but also to provide a degree of lightness and flexibility so that the user may easily press the distal edge 18 into corner C with some degree of compliant accommodation therebetween.

Figure 5:
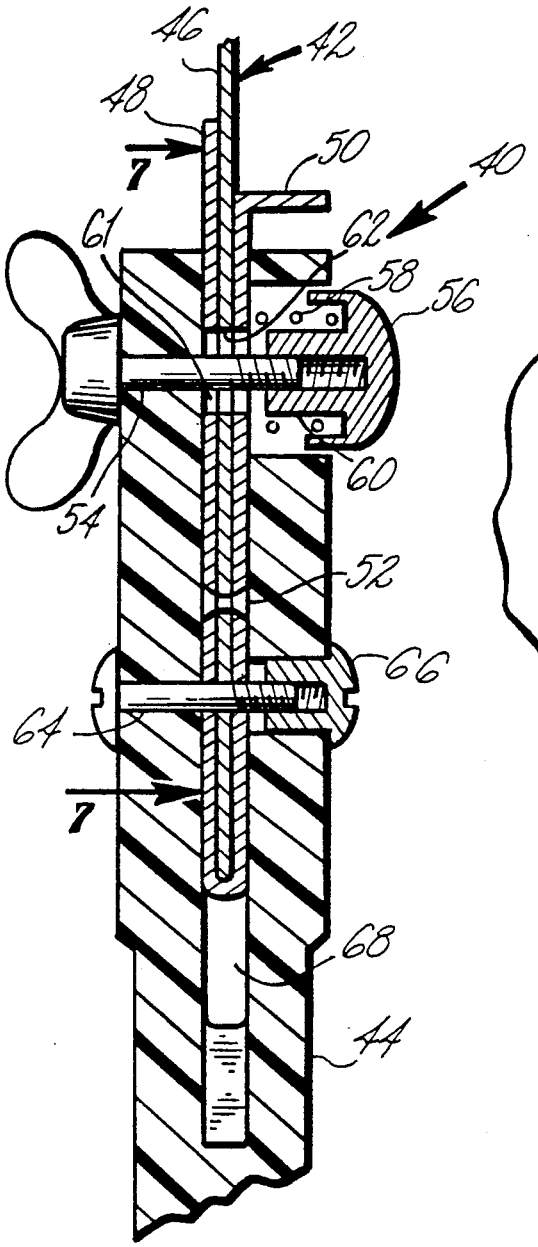
FIG. 5 is a side elevation section view of another embodiment of the invention.
Figure 7:
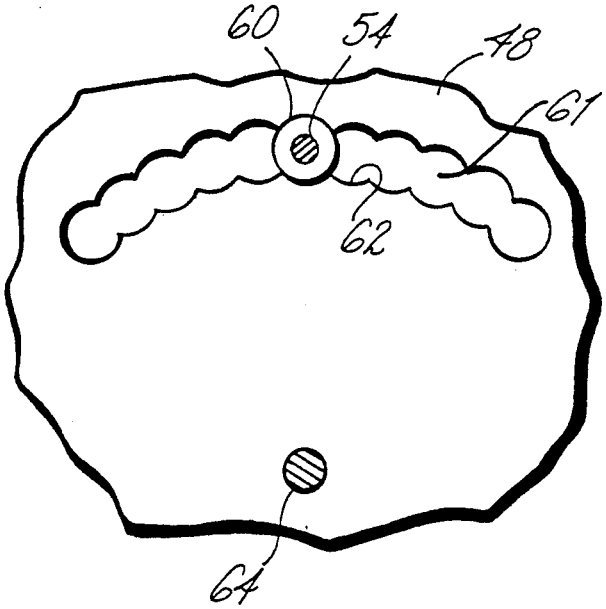
FIG. 7 is a section view in the direction of arrows 7—7 in FIG. 5.
Figure 6:
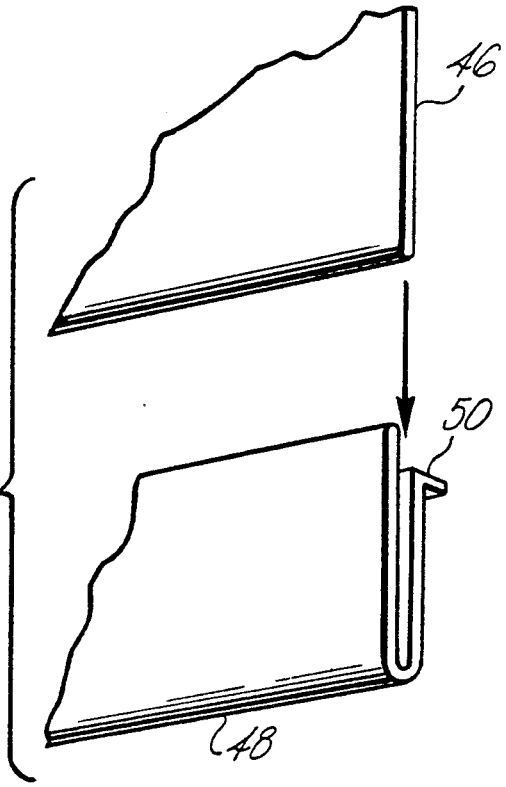
FIG. 6 is an exploded perspective view of the flat sheet assembly of FIG. 5.

Referring now to FIGS. 5, 6 and 7, another embodiment of the invention is shown generally at numeral 40 and includes a shield assembly 40 having an elongated, thin, flexible sheet 46 as previously described and a U-shaped reinforcement 48 with drip flange 50 connected integral therewith. Flexible sheet 46 slides within U-shaped reinforcement 48 as best seen in FIG. 6 and is held thusly by a plurality of rivets 52 as shown in FIG. 5. In this embodiment 40, one longitudinal edge of the shield assembly 42 fits within a longitudinal slot 68 in the upper end of handle 44 which is made pivotally connected within the plane of flexible sheet 46 by threaded fastener 64 which matably engages within cap nut 66 as shown. The threaded fastener 64 is maintained at a specific preselected tension and need not be frequently adjusted.

To accomplish any selected angular reorientation between handle 44 and assembly 42, a wing nut-type threaded fastener 54, passing through a mating aperture formed transversely through a portion of the upper end of handle 44 as shown, threadably engages within a special cap nut 56. This cap nut 56 is spring biased outwardly by compression spring 58 around cylinder 60 of cap nut 56. An arcuate slot 61 disposed uniformly about threaded fastener 64 is formed through assembly 42 as shown. This arcuate slot 61 includes a plurality of opposing aperture segments 62 along each edge which form sufficient amount of contact against cylinder 60 so as to maintain the preselected angular relationship of handle 44 therewithin.

Thus, as threaded fastener 54 is manually loosened and cap nut 56 is outwardly driven by compression spring 58, cylinder 60 disengages from the arcuate aperture 61 to allow for a reselection of angular relationship of handle 44 to flat sheet 46. Thereafter, when threaded fastener 54 is retightened, cylinder 60 reengages into one of the selected aperture segments 62 to secure the selected angle of handle 44.

Figure 8:
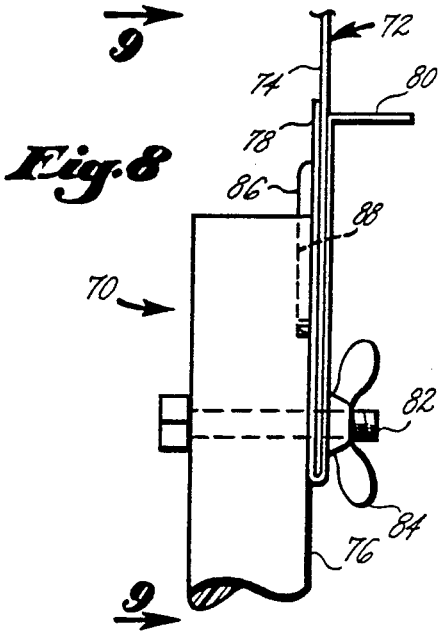
FIG. 8 is a partial side elevation view of another embodiment of the invention.
Figure 9:
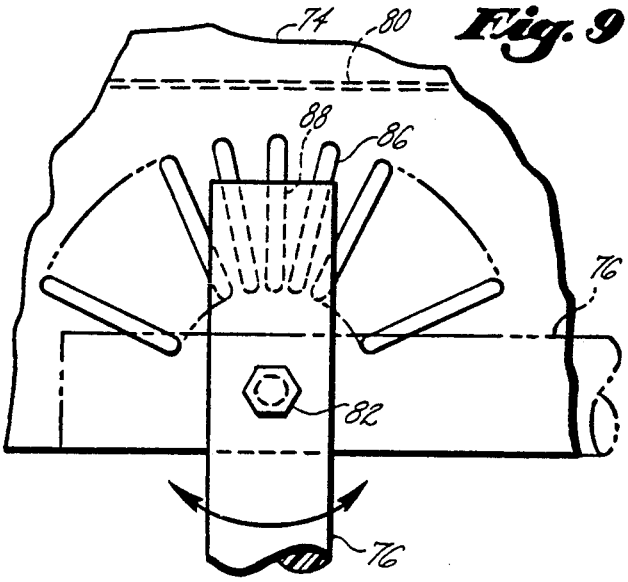
FIG. 9 is a view in the direction of arrows 9—9 in FIG. 8.

Referring now to FIGS. 8 and 9, another embodiment of the invention is shown generally at numeral 70 having a shield assembly 72 which includes a flexible, flat elongated sheet 74 securely connected within U-shaped reinforcement 78 having drip shield 80 as previously described. An elongated handle 76 is pivotally connected by threaded fastener 82 to the lower edge of the shield assembly 72 with the handle being disposed from the back side of assembly 72. This allows the handle 76 to be rotated fully parallel to the edge of assembly 72 as shown in phantom in FIG. 9 for convenient storage.

To maintain a preselected angular relationship between handle 76 and shield assembly 72, a plurality of radially extending beads 86 are formed in the back surface thereof. These beads 86 mate within cavities or recesses 88 formed in the mating surface of handle 76 as best seen in FIG. 8. Thus, when threaded fastener 82 is tightened, the preselected angular relationship between handle 76 and shield assembly 72 is established and secured.

Figure 10:
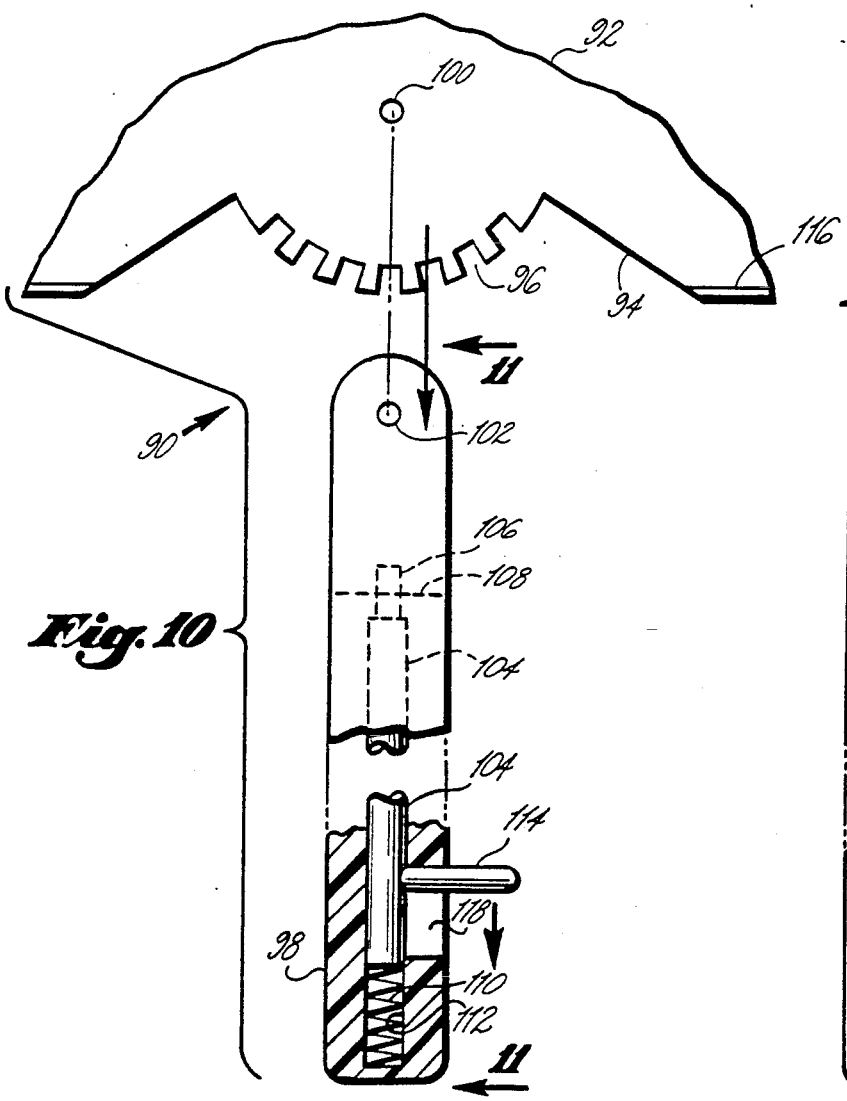
FIG. 10 is an exploded front elevation view of another embodiment of the invention.
Figure 11:
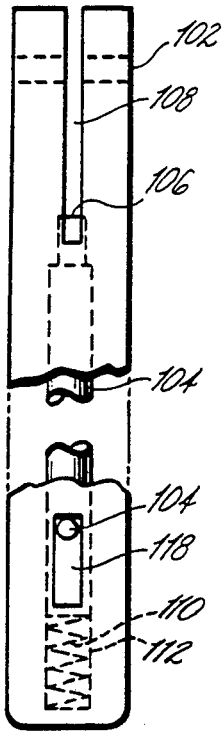
FIG. 11 is a view in the direction of arrows 11—11 in FIG. 10.

Referring now to FIGS. 10 and 11, another embodiment of the invention is shown at numeral 90. This embodiment deletes the U-shaped reinforcement in favor of the slightly thicker stock material to form flat sheet 92 and a laterally extending drip flange 116. Handle 98 is pivotally connected at aperture 102 through aperture 100 in flat sheet 92 by a tightenable threaded fastener (not shown).

In this embodiment 90, the user may easily readjust the angular relationship between handle 98 and flat sheet 92 in one-handed fashion from the point of hand grasping of handle 98. This is facilitated by the incorporation of an elongated longitudinally translatable shaft 104 mounted within a mating cavity 112 in handle 98. This shaft 104 is spring biased upwardly by compression spring 110 within longitudinal cavity 112 so as to be maintained in the position shown.

In the position shown, the reduced end 106 of shaft 104 matably engages within one of a plurality of teeth 96 formed arcuately about aperture 100 in flexible sheet 92. Positioned within slot 108, flexible sheet 92 will thus be maintained in its preselected angular relationship to handle 98 by this means.

A tab 114 laterally extends out from handle 98 through cavity 118 so that a user may easily move this tab 114 downwardly in the direction of the arrow shown in FIG. 10, thereby disengaging the end 106 of shaft 104 from any of the teeth 96. At this point, the user may conveniently readjust the angular relationship between handle 98 and flexible sheet 92, after which tab 114 is released to reengage the shaft end 106 within one of the teeth 96. In this embodiment, the degree of angular adjustment is limited by surface 94 against the side of shaft 98.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A paint spray shield for manually protectively covering a portion of a wall or ceiling when the adjoining ceiling or wall portion, respectively, is being spray painted, comprising:

a generally flat, elongated sheet of thin, flexible material having a straight longitudinal distal edge, one side of said sheet defining a working surface against which spray paint is collected when said distal edge is held against a flat surface;

an elongated handle pivotally connected at one end to said flat sheet at a mid point of a second longitudinal edge of said flat sheet opposite said distal edge;

said handle pivotally movable and extending from said second edge generally within a plane defined by said flat sheet;

locking means between said handle and said flat sheet for releasably maintaining a preselected acute angle between said distal edge and said handle;

wherein said locking means comprises:

an elongated, threaded fastener passing transversely through a mating handle aperture in said handle spaced from said handle pivotal connection;

said handle aperture in alignment and registry with an arcuate slot formed in said flat sheet whereby said flat sheet may be rotated about said handle pivotal connection and secured at any desired orientation by tightening of said threaded fastener.

2. A paint spray shield as set forth in claim 1, wherein said locking means comprises:

an elongated, threaded fastener passing transversely through a mating handle aperture in said handle spaced from said handle pivotal connection;

said handle aperture in alignment and registry with an arcuate slot formed in said flat sheet whereby said flat sheet may be rotated about said handle pivotal connection and secured at any desired orientation by tightening of said threaded fastener.

3. A paint spray shield as set forth in claim 2, wherein:

said arcuate slot includes a plurality of opposing aperture segments along said arcuate slot which selectively mate and align with said handle aperture;

said threaded fastener passing through said handle aperture and one selected said aperture segment to fixedly secure a particular angular relationship between said distal edge and said handle.

4. A paint spray shield as set forth in claim 1, wherein said locking means comprises:

a plurality of raised beads formed in and extending from one side of said flat sheet;

said plurality of beads radially spaced about said handle pivotal connection;

at least one groove formed in a surface of said handle which mates against said flat sheet;

said at least one groove alignable with one of said plurality of beads when said handle pivotal connection is released;

said at least one groove and one of said plurality of said beads fixedly securing a particular angular relationship between said distal edge and said handle when said handle pivotal connection is tightened.

5. A paint spray shield as set forth in claim 1, wherein said locking means comprises:

an elongated spring biased shaft having a first and second end and mounted within said handle for limited longitudinal translation therewithin between a first and second position, said shaft spring biased toward said first position;

said shaft first end engaging one of a plurality of teeth formed into said flat sheet in a radial array about said handle pivotal connection when said shaft is in said first position thereby fixedly securing a particular angular relationship between said distal edge and said handle;

said shaft first end disengaging from said plurality of teeth when said shaft is in said second position thereby releasing said handle for pivotal repositioning with respect to said distal edge;

said shaft second end having a hand graphing tab laterally extending from said handle for manually moving said shaft between said first and second positions.

* * * * *

UNITED STATES PATENT AND TRADEMARK OFFICE

CERTIFICATE OF CORRECTION

PATENT NO. : 5,103,762

DATED : April 14, 1992

INVENTOR(S) : Chris D. Long and Edward K. Guerry

It is certified that error appears in the above-identified patent and that said Letters Patent is hereby corrected as shown below:

Claim 2, Col. 5, lines 20-29 should be deleted.

Column 5, line 30, rewrite "2" as -- 1 --.

Signed and Sealed this

Twenty-ninth Day of June, 1993

*Attest:*

Michael K. Kirk

MICHAEL K. KIRK

*Attesting Officer*

*Acting Commissioner of Patents and Trademarks*